United States Patent [19]

Mojonnier

[11] 4,356,954

[45] Nov. 2, 1982

[54] RECLOSABLE BAG AND METHOD OF CLOSING SAME

[76] Inventor: Albert B. Mojonnier, P.O. Box 188, Eaton, Ind. 47338

[21] Appl. No.: 259,259

[22] Filed: Apr. 30, 1981

[51] Int. Cl.[3] ..... B65D 33/16

[52] U.S. Cl. ..... 229/65; 229/62; 428/35

[58] Field of Search ..... 229/65, 62; 428/35

[56] References Cited

U.S. PATENT DOCUMENTS

| | | | |
|---|---|---|---|
| 2,241,835 | 5/1941 | Wentz . | |
| 2,973,131 | 2/1961 | Mead et al. . | |
| 3,189,253 | 6/1965 | Mojonnier . | |
| 3,545,668 | 12/1970 | Hultberg | 229/65 |
| 3,784,087 | 1/1974 | Styers | 229/62 |
| 3,865,304 | 2/1975 | Mojonnier et al. | 229/65 |

*Primary Examiner*—William R. Dixon, Jr.
*Attorney, Agent, or Firm*—Vernon J. Pillote

[57] ABSTRACT

A reclosable bag of the type having opposed flexible side walls and a deformable flat closure strip extending across one of the side walls and projecting from opposite side edges of the bag. The projecting end portions of the deformable closure strip are formed with a lateral tab outwardly of the side edges of the bag. The bag is adapted to be reclosed by roll-folding the top portion a number of times and then bending the projecting end portions of the deformable member inwardly to overlap the roll-folded top portion at one side of the bag and thereafter bending the tabs downwardly to overlap the roll-folded top portion at the other side of the bag.

17 Claims, 12 Drawing Figures

Fig. 1.
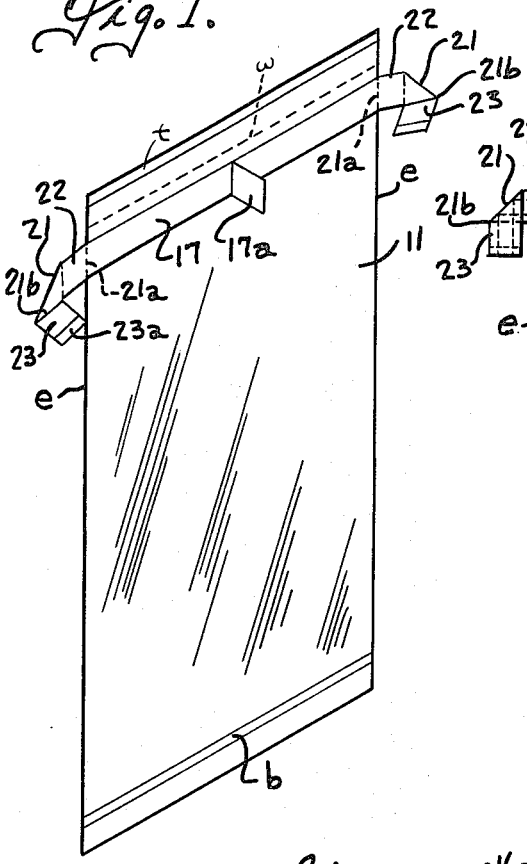
Fig. 2.
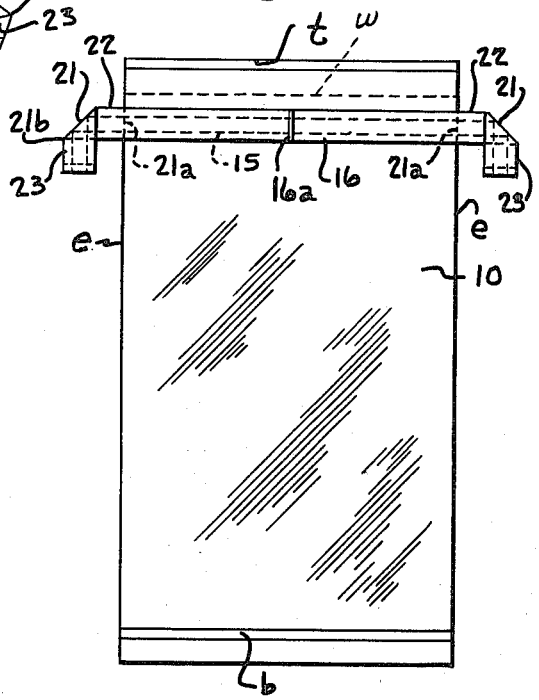
Fig. 3.
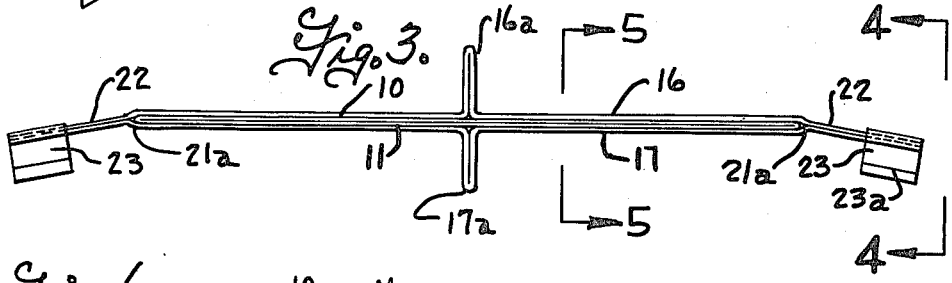
Fig. 6.
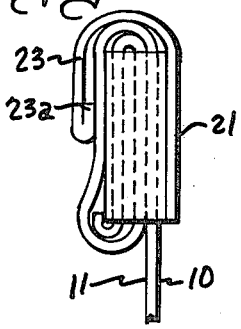
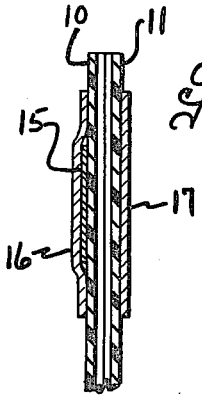
Fig. 5.
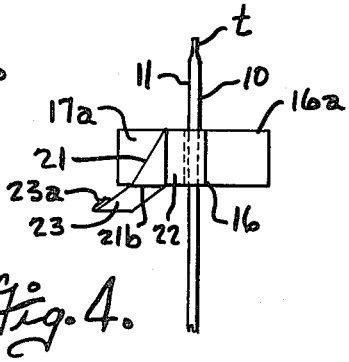
Fig. 4.

Fig. 7.
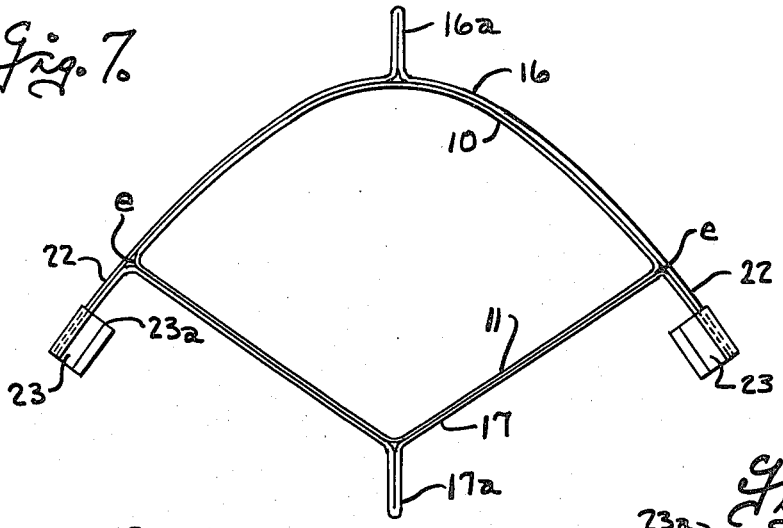
Fig. 8.
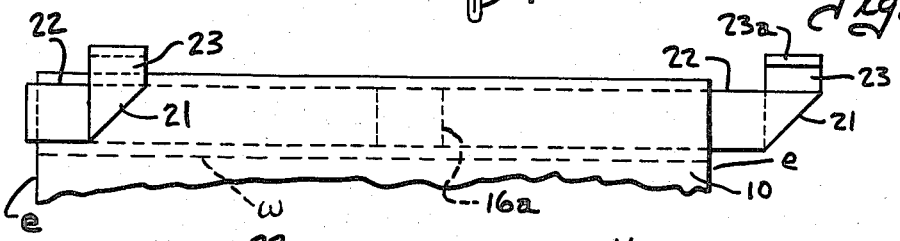
Fig. 9.
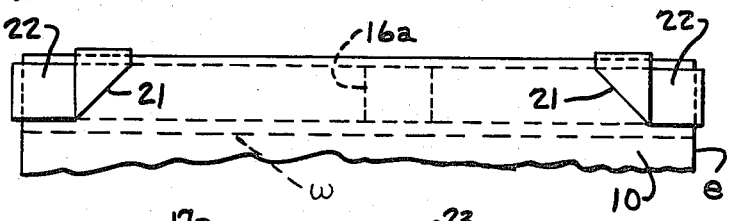
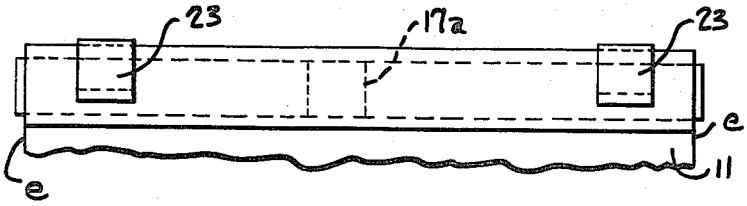
Fig. 10.
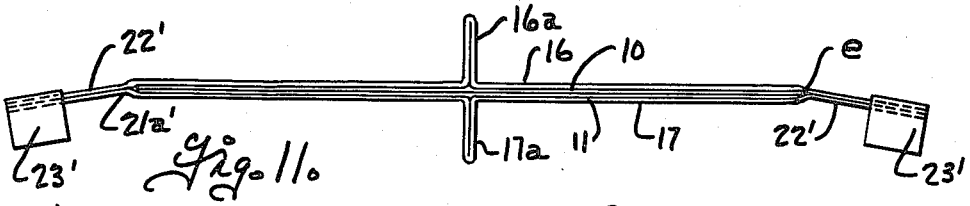
Fig. 11.
Fig. 12.
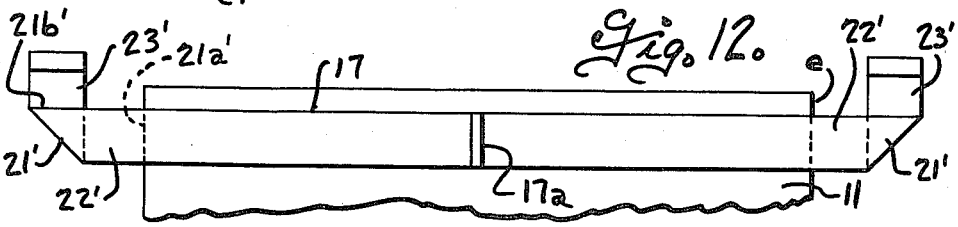

RECLOSABLE BAG AND METHOD OF CLOSING SAME

BACKGROUND

Reclosable bags of the type shown in U.S. Pat. Nos. 2,973,131 and 3,189,253 have been marketed for many years. In those bags, an elongated deformable closure strip extended across one side wall of the bag adjacent the top opening with end portions projecting out from opposite side edges of the bag, and the bag was adapted to be closed by first roll-folding the top of the bag around the closure strip a number of times and thereafter folding the projecting portions of the closure strip laterally inwardly to overlap the bag at the side opposite the roll-folded top and hold the same against unrolling. Problems, however, were encountered when the bag was not reclosed in the proper manner. If the projecting end portions are folded laterally inwardly to extend alongside the rolled top of the bag instead of over the side of the bag opposite the rolled top, the rolled top can unroll at least one-half turn. More seriously, if the projecting end portions were not properly folded inwardly, the ends of the deformable member sometimes pierced the bag wall and caused leakage.

It has also been proposed as shown in U.S. Pat. No. 2,241,835 to make a reclosable container in which the deformable member extends across the top of the container and has projecting portions that extend outwardly from opposite side edges of the container and additionally has tongues that extend laterally from the deformable member intermediate the side edges of the container. With the laterally extending tongues located intermediate the side edges of the container, the top of the container could only be folded once to effect closing and could not be roll-folded a number of times as would be required to assure a liquid tight closure, particularly when used on very thin and flexible walled bags.

SUMMARY OF THE INVENTION

It is the object of the present invention to overcome the disadvantages of the prior art by providing a bag having an improved deformable closure strip which will reliably provide a liquid tight closure.

Another object of this invention is to provide a bag having an improved deformable closure strip which is arranged to substantially assure folding of the deformable closure strip in the proper manner and in proper sequence.

Still another object of this invention is to provide a reclosable bag which can be economically produced and which can be easily manipulated to effect reclosing and sealing of the bag.

Accordingly, the present invention provides, a reclosable bag formed of flexible sheet material and including first and second opposed side walls connected along the side edges of the bag and at the bottom of the bag and with a top opening means at the upper end of the bag, and bag closing means including an elongated deformable closure member having an intermediate portion extending across and secured to the first side wall of the bag adjacent the top opening and projecting portions extending from opposite side edges of the bag, the projecting portions of the closure member each including a tongue extending outwardly from a respective side edge of the bag and an integral tab extending laterally from the tongue at a location spaced outwardly from the respective side edge of the bag, the top portion of the bag being adapted to be roll-folded over a number of times around the intermediate portion of the deformable closure member to close the bag, the tongues being adapted to be folded inwardly to overlap the roll-folded top portion of the bag at one side thereof, and the tabs adapted to be folded over the top of the roll-folded top portion of the bag and downwardly to overlap the roll-folded top portion at the other side of the bag.

The tongues are advantageously bent along a line adjacent the respective side edge of the bag to extend at an angle to the intermediate portion of the deformable member, to facilitate in-folding of the tongues. The tabs are advantageously bent along a line transversely thereof to extend at an angle to one side of the respective tongue, to facilitate folding of the tabs over the top of the roll-folded top portion of the bag and against the side of the roll-folded top portion opposite the tongue.

These, together with other objects, features and advantages of this invention will be more readily understood by reference to the following detailed description, when taken in connection with the accompanying drawings wherein:

FIG. 1 is a perspective view of the bag construction in accordance with the present invention and showing the same in an initially closed condition;

FIG. 2 is a side elevational view of the bag from one side thereof;

FIG. 3 is a top plan view of the bag showing the same on a larger scale than FIG. 2;

FIG. 4 is a fragmentary end elevational view taken on the plane 4—4 of FIG. 3;

FIG. 5 is a fragmentary transverse sectional view taken on the plane 5—5 of FIG. 3 and illustrating parts on a larger scale;

FIG. 6 is a fragmentary end elevational view of the top portion of the bag when roll-folded and closed;

FIG. 7 is a top view of the bag shown in an opened condition;

FIG. 8 is a fragmentary side elevational view of the bag after it has been roll-folded a number of times and with the tongue at the left side of the bag folded inwardly to overlie one side of the bag;

FIG. 9 is a fragmentary side elevational view of the bag after the top has been roll-folded a number of times and with the tongues at both sides of the bag folded inwardly to overlie the bag at one side and with the tabs on the ends of the tongue folded downwardly to overlap the roll-folded top portion of the bag at the other side thereof;

FIG. 10 is a fragmentary view of the reclosed bag at the side opposite the side shown in FIG. 9;

FIG. 11 is a top view of the bag having a modified bag reclosure; and

FIG. 12 is a fragmentary side elevational view of the modified bag of FIG. 11.

The bag is formed of flexible sheet material and may, for example, be formed of thin plastic material such as polyethylene. The bag has opposed side walls, herein sometimes referred to as a first or rear side wall 10 and a second or front side wall 11, and which walls are connected together along their side edges e and also along a line b adjacent the bottom. In order to maintain the bag in a sterile condition prior to use, the side walls 10 and 11 are advantageously initially connected together along a heat seal line t adjacent their top and a line of weakness w is provided in the side walls to enable removal of the top portion as by tearing along the line of weakness. As shown herein, the line of weakness comprises a row of perforations, it being understood that it could be formed by score lines that extend partially through the film. Alternatively, if it is not necessary to maintain the bag in a sterile condition, the bag as initially formed can be open at the top. Thus, it is contemplated that the bag can be formed either to initially have a top opening or, alternatively, to initially have a closed top which is removable to provide a top opening for the bag. In the embodiment illustrated, the bag is conveniently formed of flattened tubular stock which is folded along the side edges e of the bag to provide opposed side walls 10 and 11 and in which the side walls are heat sealed together along the bottom heat sealed line b and along a top heat sealed line t. Alternatively, the bags can be formed from separate sheets and heat sealed together not only along the top and bottom, but along the side edges e of the bag.

An elongated deformable closure member is applied to one side wall of the bag adjacent the top. The bag closure member is preferably formed in a manner disclosed in the applicant's prior U.S. Pat. No. 3,189,253 and the bag closure member is preferably applied to the bag by the method and apparatus disclosed in the applicant's prior U.S. Pat. No. 3,188,925. The elongated deformable closure member includes an elongated flat strip 15 (FIG. 5) of ductile metal such as soft iron, aluminum or the like that overlies one side wall 10 of the bag adjacent the top thereof and the strip of metal is conveniently attached to the side wall of the bag by a band 16 of a flexible material such as a plastic material. The band 16 can conveniently comprise a strip of tape having an adhesive coating on one side to adhesively bond to the outer face of the metal strip 15, and the band of tape is wider than the metal strip so that the edge portions of the band 16 adhesively bond to the outer face of the side wall 10 of the bag to secure the metal strip to the bag. A second band 17 of flexible material such as plastic is advantageously secured to the other side wall 11 in opposed relation to the band 16. Each of the bands 16 and 17 are preferably formed with a portion intermediate their ends folded outwardly and back upon itself to provide flexible pull tabs 16*a* and 17*a*. The strip 15 of ductile metal and the flexible band 16 are substantially longer than the width of the bag and the end portions of the strip 15 and band 16 extend outwardly from opposite side edges e of the bag. The band 17 is preferably co-extensive with the strip 15 and band 16 overlies the projecting portions of the strip 15 and band 16.

The deformable closure strips are formed so as to provide lateral tabs on the deformable strips spaced outwardly from the side edges of the bag. For this purpose, each of the projecting portions of the deformable strip are diagonally flat-folded across itself along the fold line 21 that extends diagonally of the projecting portion intermediate the ends thereof to form each projecting portion into a generally flat tongue 22 between the fold line and the side edge of the bag and a generally flat tab 23 that extends laterally from the tongue and is spaced outwardly from the side edge of the bag. The tips of each of the tabs are preferably folded back upon itself a short distance as indicated at 23*a* to provide a blunt end on the tabs. The projecting portions can be folded so that the fold line 21 diverges downwardly relative to the respective side edge of the bag and the tabs 23 extend from the lower edge of the respective tongue 22 as shown in the embodiment of FIGS. 1–10. Alternatively, the projecting portions can be folded as shown in FIGS. 11 and 12 so that the fold lines 21' diverge upwardly relative to the respective side edges of the bag and the tabs 23' extend from the upper edge of the respective tongue 22'.

The bag is adapted to be reclosed by roll-folding the top portions of the bag over a number of times to close the bag. When the projecting portions are formed so that the tabs 23 initially extend from the lower edge of the respective tongue, as shown in FIGS. 1–10, the top of the bag should be roll-folded an odd number of times to close the bag, for example three, so as to position the tabs 23 at a level adjacent the top of the roll-folded top, as shown in FIG. 8. When the projection portions are diagonally folded so that the tabs initially project from the upper side of the respective tongue, as shown in FIGS. 11 and 12, then the top of the bag should be roll-folded an even number of times such as two or four to close the bag, to position the tabs at a level adjacent the top of the roll-folded top. The embodiment of FIGS. 1–10 is preferred since three turns make a good closure and arranging the tabs so that they initially extend from the underside of the respective tongue reduces the space required in the box or container for the bags.

After the top of the bag is closed by roll-folding of the top portion of the bag a number of times around the intermediate portion of the deformable strip, the tongues are adapted to be folded inwardly to overlap the roll-folded top portion of the bag at one side thereof. In order to facilitate in-folding and to suggest to the bag user the manner and direction in which the tongues should be folded, the tongues are advantageously bent along a line 21*a* adjacent the juncture of the tongue with the side edge of the bag so that the tongue initially extends at an obtuse included angle to the intermediate portion of the deformable strip. The tongues are preferably folded in a direction so as to overlap the side of the bag opposite the side to which the roll is formed. For example, if the side wall 11 of the bag is considered the front wall and the top of the bag roll-folded forwardly an odd number of times as shown in FIG. 6, the tongues 22 when folded inwardly will overlap the rear side wall 10 of the bags, and hold the roll-folded top against unrolling. In order to facilitate and suggest this manner of folding to the user, the tongues are bent forwardly at an obtuse included angle relative to the intermediate portion of the deformable member, as best shown in FIG. 3.

After the tongues 22 are folded inwardly to overlap one side of the roll-folded top portion of the bag, the tabs 23 are adapted to be folded over the top of the roll-folded top portion and downwardly to overlap the roll-folded top portion of the bag at the other side thereof, as best shown in FIGS. 6, 9, and 10. In order to facilitate folding of the tabs and to also suggest the proper folding direction to the bag user, the tabs 23 are each bent along a line 21*b* to extend at an obtuse included angle relative to the respective tongue 22. In the embodiment shown in FIGS. 1–10 in which the tongues are bent forwardly relative to the intermediate portion so that they overlap the rear side of the roll-folded top portion of the bag, the tabs 23 are also bent forwardly relative to the respective tongue so that the tab projects over the top of the roll-folded top portion when its associated tongue is folded inwardly, as shown at the left in FIG. 8. The tabs can then be folded downwardly to engage the roll-folded top portion at the other side of the bag.

Since the tabs, when folded, engage the roll-folded top portion of the bag at the side opposite the tongue, they hold the roll-folded top portion against unrolling. In addition, the tabs aid in holding the tongues in their folded condition against the other side of the roll folded top portion. Further, since the tabs, when folded, are firmly positioned against the roll-folded top portion, they do not contact the bag below the roll-folded top portion and pierce or rupture the bag and cause leakers.

When the projecting end portions are folded so that the tabs 23 are initially extended from the upper side of the respective tongue 22', as shown in FIGS. 11 and 12, the tongues can also advantageously be folded along the line 21*a'* to extend forwardly at an obtuse included angle relative to the front wall 11 of the bag and the tabs 23' folded along a line 21*b'* to extend forwardly at an obtuse included angle relative to the respective tongue 11'. However, since the top of the bag must be roll-folded an even number of times when the tabs initially extend from the upper edge of the tongues, the top in the embodiment of FIGS. 11 and 12, should be roll-folded toward the rear side wall 10 of the bag an even number of times. The tongues can then be folded forwardly to overlie the front side wall 11 of the bag and the tabs 23' thereafter folded downwardly to overlie the roll folded top portion at the rear side of the bag.

As previously described, the bags can be formed and the ductile member 15 and adhesive tape bands 16 and 17 can conveniently be applied in the manner disclosed in applicant's prior U.S. Pat. No. 3,188,925. Thereafter, the projecting portions of the band can be bent in a manner described above. Preferably, the tips of the projecting portions are initially folded back upon themselves as shown at 23*a* to provide a blunt end on the tabs. Thereafter, the projecting portions can be diagonally flat-folded across themselves to form the projecting portions into a tongue between the fold line and the side edge of the bag and a tab extending laterally from the tongue and spaced outwardly from the side edge of the bag. The tongue can be bent relative to the side wall and the tab bent relative to its tongue by suitable forming dies.

From the foregoing it is thought that the construction and use of the reclosable bag will be readily understood. Bags of the type disclosed are commonly used for collecting milk samples and are shipped in a flattened condition with the tops of the bags initially closed by the top seal t. The bag is opened at the point of use by tearing along the line of weakness w and the top of the bag can then be opened by pulling on the pull tabs 16*a* and 17*a* to open the bag as shown in FIG. 7. After the liquid is deposited in the bag, the bag is again flattened and then roll-folded a number of times to close the top of the bag. In the embodiment of FIGS. 1–10 in which the tabs initially extend from the upper edge of the tongues, the bag is roll-folded an odd number of times to position the tabs above the level of the roll-folded top portion of the bag and the tongues are then folded inwardly to overlie the side of the bag opposite the roll-folded portion. The tabs are then bent downwardly across the roll-folded top portion and against the other side of the roll-folded top portion, as shown in FIGS. 6, 9 and 10. Since the tabs and tongue engage opposite sides of the roll-folded top portion, they hold the roll-folded top portion against unrolling. In addition, the ends of the tabs are disposed on the roll-folded top portion and are not in a position to engage the bag below the roll-folded top portion. The bend between the tongues 22 and the intermediate portion of the deformable members along line 22*a* facilitates and suggests the proper direction of bending to the user. In addition, the bend between the tabs and the respective tongue also facilitates and suggests the proper direction of bending to the user.

The embodiments of the invention in which an exclusive property or privilege is claimed are defined as follows:

1. In a reclosable bag formed of flexible sheet material and including first and second opposed side walls connected along the side edges of the bag and at the bottom of the bag, the bag having top opening means at the upper end thereof, bag reclosing means including an elongated deformable member having an intermediate portion extending across and secured to the first side wall of the bag adjacent the top opening means and projecting portions extending from opposite side edges of the bag, the improvement wherein said projecting portions each include a tongue extending outwardly from a respective side edge of the bag and an integral tab extending laterally from the tongue at a location spaced outwardly from the respective side edge of the bag, the top portion of the bag being adapted to be roll-folded over a number of times around the intermediate portion of the deformable member to close the bag, the tongues being adapted to be folded inwardly to overlap the roll-folded top portion of the bag at one side thereof, the tabs being adapted to be folded over the top of the roll-folded top portion of the bag and downwardly to overlap the roll-folded top portion at the other side of the bag.

2. In a reclosable bag formed of flexible sheet material and including opposed first and second side walls connected along the side edges of the bag and at the bottom of the bag, the bag having top opening means at the upper end thereof, elongated generally flat strip means including an elongated deformable member, the strip means having an intermediate portion extending across and secured to the first side wall of the bag adjacent the top opening means and projecting portions extending from opposite side edges of the bag, the improvement wherein the projecting portions each include a generally flat tongue extending outwardly from a respective side edge of the bag and a generally flat tab extending laterally from the tongue at a location spaced outwardly from the respective side edge of the bag, the top portion of the bag being adapted to be roll-folded over a number of times to close the bag, the tongues being adapted to be folded inwardly to overlap the roll-folded top portion of the bag at one side thereof, the tabs being adapted to be folded over the top of the roll-folded top portion of the bag and downwardly to overlap the roll-folded top portion at the other side of the bag.

3. A reclosable bag according to claim 2 wherein the tabs are bent along a line transversely thereof to extend at an obtuse included angle to one side of the respective tongue.

4. A reclosable bag according to claim 3 wherein the tongues are bent along a line adjacent the respective side edge of the bag to extend at an obtuse included angle to the intermediate portion of the strip means.

5. In a reclosable bag formed of flexible sheet material and including first and second opposed side walls connected along the side edges of the bag and at the bottom of the bag, the bag having top opening means at the upper end thereof, elongated generally flat strip means including an elongated deformable member, the elongated strip means having an intermediate portion extending across and secured to the first side wall of the bag adjacent the top opening means and projecting portions extending from opposite side edges of the bag, the improvement comprising the projecting portions each being diagonally flat-folded across itself along a fold line diagonally of the projecting portion and intermediate the ends thereof to form each projecting portion into a generally flat tongue between the fold line and the side edge of the bag and generally flat tab extending laterally from the tongue, the top portion of the bag being adapted to be roll-folded over a number of times around the intermediate portion of the strip to close the bag, the tongues being adapted to be folded inwardly to overlap the roll-folded top portion of the bag at one side thereof and the tabs being adapted to be folded over the top of the roll-folded top portion and downwardly to overlap the roll-folded top portion of the bag at the other side thereof.

6. A reclosable bag according to claim 5 wherein the fold line in each projecting portion diverges downwardly relative to the respective side edge of the bag and the tabs extend from the lower edge of the respective tongue.

7. A reclosable bag according to claim 5 wherein the fold line in each projecting portion diverges upwardly relative to the respective side edge of the bag and the tabs extend from the upper edge of the respective tongue.

8. A reclosable bag according to claim 5 wherein the tabs are bent along a line transversely thereof to extend at an obtuse included angle to one side of the respective tongue.

9. A reclosable bag according to claim 8 wherein the tongues are each bent along a line adjacent the respective side edge of the bag to extend at an obtuse included angle to the intermediate portion of the strip means.

10. A reclosable bag according to claim 5 wherein the tongues are each bent along a line adjacent the respective side edge of the bag to extend at an obtuse included angle to the intermediate portion of the strip.

11. A reclosable bag according to claim 5 wherein said elongated deformable member is a flat strip of ductile metal.

12. A reclosable bag according to claim 5 wherein said elongated deformable member is a flat strip of ductile metal, said elongated strip means also including a first band of flexible tape at least as long as said strip, and wider than said strip and adhesively secured to said strip and to said first side wall of said bag.

13. A reclosable bag according to claim 12 including a second band of flexible tape adhesively secured to said second side wall of said bag and to the projecting portions of said elongated strip means.

14. A reclosable bag according to claim 13 wherein said each of said bands of flexible tape have a portion intermediate their ends folded outwardly and back upon itself to provide a flexible pull tab at each side of the bag.

15. A reclosable bag according to claim 5 wherein said first and second side walls extend above said strip means and are connected adjacent their upper edges to initially close the top of the bag, said first and second side walls each having a line of weakness intermediate the strip means and the upper edges thereof permitting removal of the upper portions of the side walls of the bag to provide said top opening means at the upper end of the bag.

16. A reclosable bag according to claim 5 wherein the tip of each of the tabs is folded back upon itself a short distance to provide a blunt end on the tab.

17. A method of reclosing a bag formed of flexible sheet material and including opposed first and second side walls connected along the side edges of the bag and at the bottom of the bag, the bag having top opening means at the upper end thereof, elongated generally flat strip means including an elongated deformable member, the strip means having an intermediate portion extending across and secured the the first side wall of the bag adjacent the top opening means and projecting portions extending from opposite side edges of the bag, the method comprising forming each of the projecting portions with a generally flat tongue extending outwardly from a respective side edge of the bag and a generally flat tab extending laterally from the tongue at a location spaced outwardly from the respective side edge of the bag, roll-folding the top portion of the bag over a number of times to close the bag, folding the tongues inwardly to overlap the roll-folded top portion of the bag at one side thereof, and thereafter folding the tabs over the top of the roll-folded top portion of the bag and downwardly to overlap the roll-folded top portion at the other side of the bag.

* * * * *